US007121220B2

(12) United States Patent
Brosseuk

(10) Patent No.: US 7,121,220 B2
(45) Date of Patent: Oct. 17, 2006

(54) STEERING MECHANISM FOR WATERCRAFT

(75) Inventor: Raymond B. Brosseuk, Revelstoke (CA)

(73) Assignee: IE-TEC Licensing Limited, Mauritius (ZA)

( * ) Notice: Subject to any disclaimer, the term of this patent is extended or adjusted under 35 U.S.C. 154(b) by 68 days.

(21) Appl. No.: 10/814,786

(22) Filed: Apr. 1, 2004

(65) Prior Publication Data

US 2005/0145153 A1 Jul. 7, 2005

(30) Foreign Application Priority Data

Apr. 4, 2003 (ZA) ..... 2003/2710

(51) Int. Cl.
*B63H 25/06* (2006.01)
*B63H 11/117* (2006.01)

(52) U.S. Cl. ..... 114/162; 440/43

(58) Field of Classification Search ..... 440/1, 440/38, 43; 114/144 R, 162
See application file for complete search history.

(56) References Cited

U.S. PATENT DOCUMENTS 4,054,101 A 10/1977 Meade
4,949,662 A 8/1990 Kobayashi
5,050,518 A 9/1991 Okita
5,167,547 A 12/1992 Kobayashi et al.
5,244,425 A * 9/1993 Tasaki et al. ..... 440/47
5,509,369 A 4/1996 Ford et al.
5,741,166 A * 4/1998 Newman ..... 440/84
5,879,209 A 3/1999 Jones
6,178,907 B1 1/2001 Shirah et al.
6,203,038 B1 3/2001 Bernhard
6,302,047 B1 10/2001 Cannon
6,336,834 B1 * 1/2002 Nedderman et al. ..... 440/43
6,349,940 B1 2/2002 Nimry
6,428,372 B1 8/2002 Belt
6,491,554 B1 * 12/2002 Servais ..... 440/42
6,523,489 B1 2/2003 Simard et al.
6,538,217 B1 3/2003 Eriksen et al.
6,695,654 B1 * 2/2004 Simner ..... 440/43

FOREIGN PATENT DOCUMENTS

CA 1165185 4/1984
CA 2333831 2/2001

* cited by examiner

*Primary Examiner*—Jesús D. Sotelo
(74) *Attorney, Agent, or Firm*—Nixon & Vanderhye P.C.

(57) ABSTRACT

The invention relates to an apparatus for and method of automatically actuating the movement of a rudder of a watercraft between a steering and a non-steering position in response to the speed of the watercraft. This invention is particularly applicable for use in jet-propelled watercraft, which have reduced steering capacity at low speeds.

15 Claims, 6 Drawing Sheets

STEERING MECHANISM FOR WATERCRAFT

FIELD OF THE INVENTION

This invention relates to a steering mechanism for jet-propelled watercraft. More particularly, it relates to a steering mechanism for jet-propelled watercraft that is engaged at varying speeds.

DESCRIPTION OF PRIOR ART

Steering devices for watercraft are well-known. The art abounds, in particular, with references to improved rudders for such craft: U.S. Pat. No. 6,428,372, for example, makes claim to a pivotally-mounted rudder for a jet-propulsion unit, while U.S. Pat. No. 5,167,547 discloses a pivotally-mounted rudder that is movable into a steering position.

One example of the major disadvantages associated with the current art is that the watercraft cannot be steered, or cannot be steered satisfactorily if they are not accelerating, as there is insufficient water passing through the engine to provide the jet thrust that is required to steer and turn the craft. When faced with obstacles or other dangerous circumstances in the water, therefore, an operator of watercraft would necessarily be obliged to accelerate in order to provide sufficient power to manoeuvre the craft away from the danger. Such acceleration may often only serve to add to the danger of the situation, particularly for inexperienced operators, and in circumstances in which there is insufficient time to accelerate in order to avoid the danger.

Certain inventions have been directed at the partial alleviation of these disadvantages. In particular, U.S. Pat. No. 5,167,547 claims a steering rudder that is selectively operable at the operator's option, while U.S. Pat. No. 4,949,662 is directed at an auxiliary steering means to create a steering effect in a jet propulsion boat at low speeds. Other patents concentrate more generally on the coupling of an actuator onto a rudder (cf: U.S. Pat. No. 6,428,372).

While this last-mentioned patent discloses an invention that certainly aids the steering of watercraft, it does little to alleviate the second disadvantage, namely engaging an improved steering mechanism within the critical time available to avoid danger when travelling at low speeds.

OBJECT OF THE INVENTION

It is accordingly an object of the present invention to provide an improved steering mechanism for watercraft that engages automatically at off-throttle conditions, and which, at least partially, overcomes the disadvantages outlined above.

DISCLOSURE OF THE INVENTION

According to the invention there is provided a steering mechanism for jet-propelled watercraft comprising a rudder, being movable between a steering and a non-steering position, the rudder being coupled to the steering mechanism of the watercraft when it is in the steering position;

securing means for securing the steering mechanism to the watercraft;

biasing means for biasing the rudder towards the non-steering position, alternatively the steering position; and actuating means for automatically actuating the movement of the rudder against the bias of the biasing means, on the speed of the watercraft dropping below a predetermined level.

According to the invention there is provided a steering mechanism for jet-propelled watercraft comprising:

a rudder, movable between a steering and a non-steering position, and which rudder is configured to couple with the steering column of the watercraft when in the steering position;

securing means for securing the steering mechanism to the watercraft;

biasing means for biasing the rudder towards the non-steering position; and actuating means for actuating the movement of the rudder towards the steering position automatically, on the speed of the watercraft dropping below a predetermined level.

The steering mechanism is preferably affixed to the outlet nozzle of the watercraft.

The securing means may incorporate nut-and-bolt fixtures for affixing the steering mechanism to the body of the watercraft.

The rudder may incorporate a plate member located in a substantially ventral position.

The biasing means may incorporate a spring-loaded engaging member that is configured to engage the plate member of the rudder at high speeds or high nozzle velocities, and to disengage from the plate member at low speeds or low nozzle velocities.

In an alternative embodiment of the invention, the biasing means may incorporate a piston-and-lug arrangement that biases the rudder towards the non-steering position, preferably wherein the lugs are coupled to the actuating means.

The actuating means may be coupled to the speedometer, alternatively revolution-counter of the engine, of the watercraft and may incorporate speed-sensitive apparatus which, on the speed, alternatively engine-revolutions of the watercraft dropping below a predetermined level, overcomes the biasing means to reverse the direction of its bias, allowing the rudder to move towards the steering position.

In an alternative embodiment of the invention, the biasing means may be caused to reverse the direction of its bias via the activation of a source of pressure.

In such an embodiment, the source of pressure may be a pneumatic cylinder.

The source of pressure may be activated by a solenoid.

In a further alternative embodiment of the invention, the actuating means may be coupled to the outflow nozzle of the watercraft, and may incorporate pressure-sensitive apparatus, such as a feedback control device and/or venturi. On the pressure dropping below a predetermined level, the control device compels the biasing means to overcome the bias, allowing the rudder to move towards the steering position.

According to a second aspect of the invention, there is provided a method for the automatic deployment of a steering mechanism in a watercraft, comprising the step of actuating the rudder into the steering position as defined in any of the above consistories.

BRIEF DESCRIPTION OF THE DRAWINGS

In order to illustrate the invention an embodiment thereof is described hereunder purely as an example, without limiting the scope of the invention, wherein.

Figure 1:
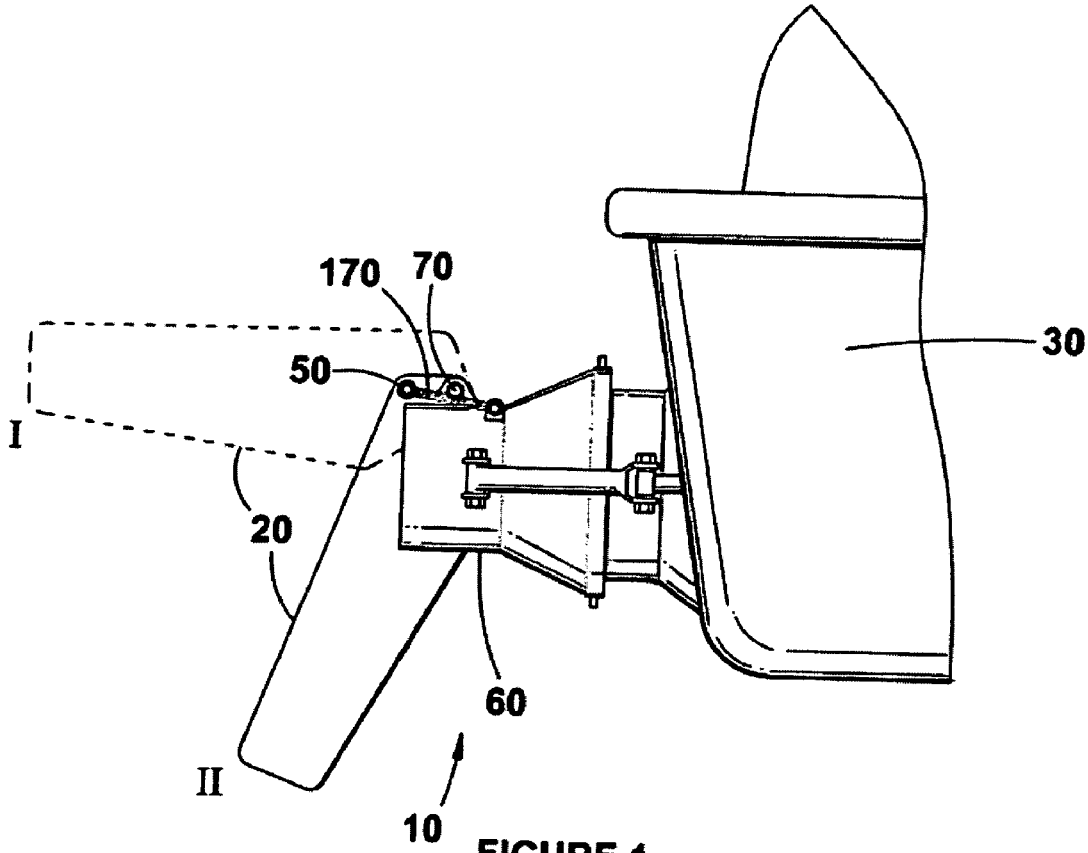
FIG. 1 is a profile view showing the steering mechanism according to a first embodiment of the invention, wherein position I depicts the rudder in a non-steering position (i.e.
Figure 2:
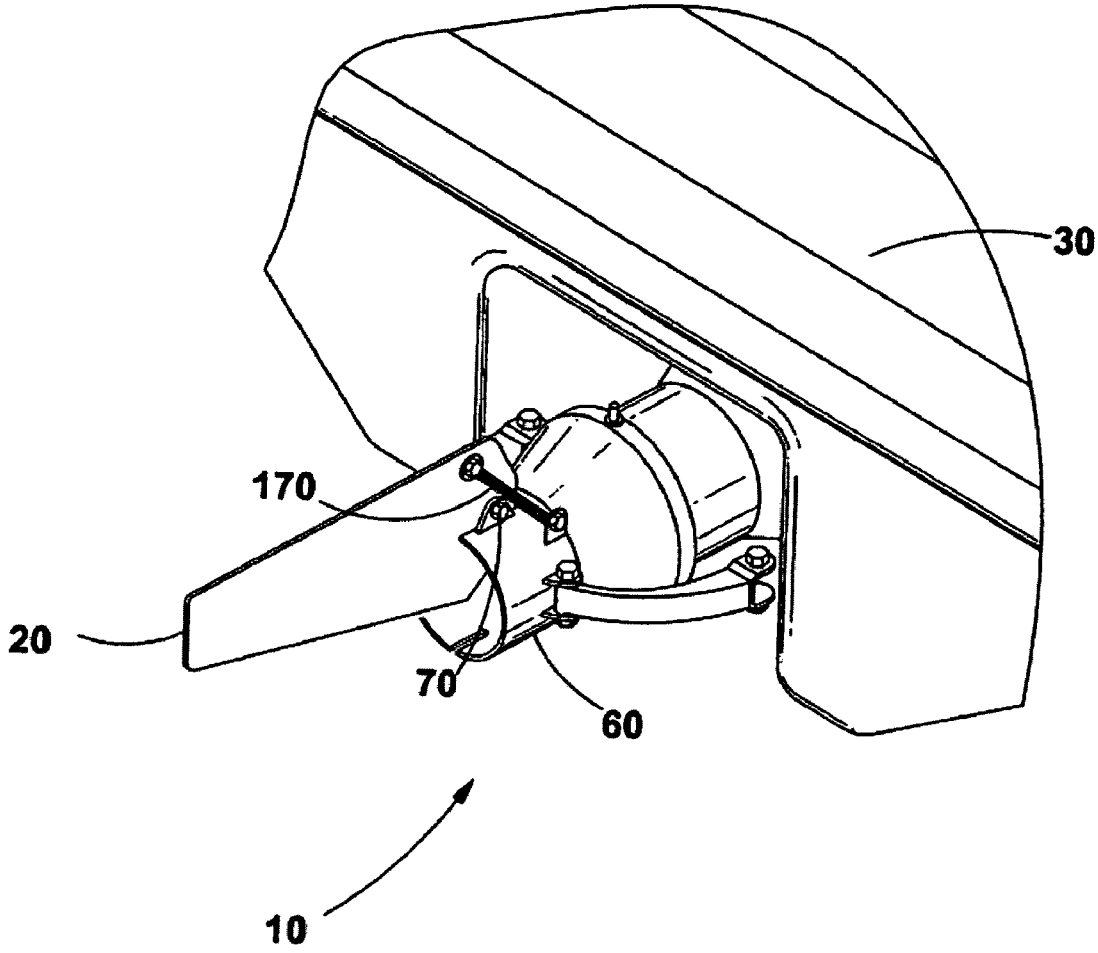
Figure 3A:
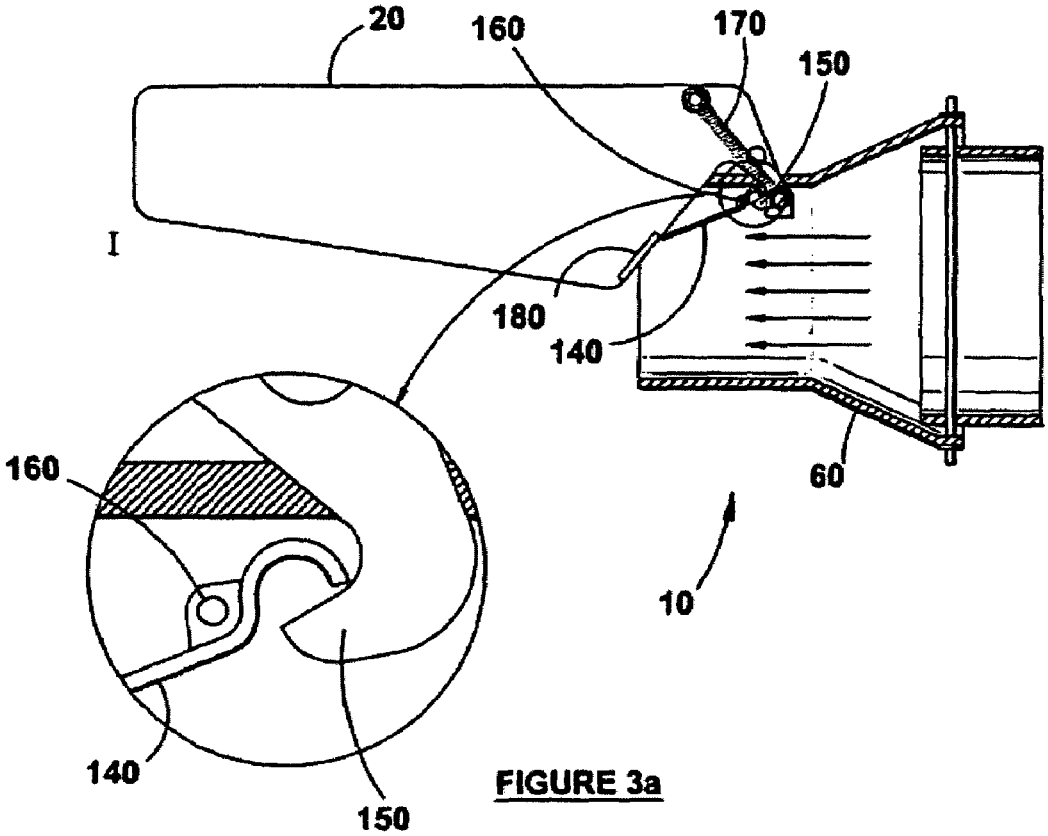
Figure 3B:
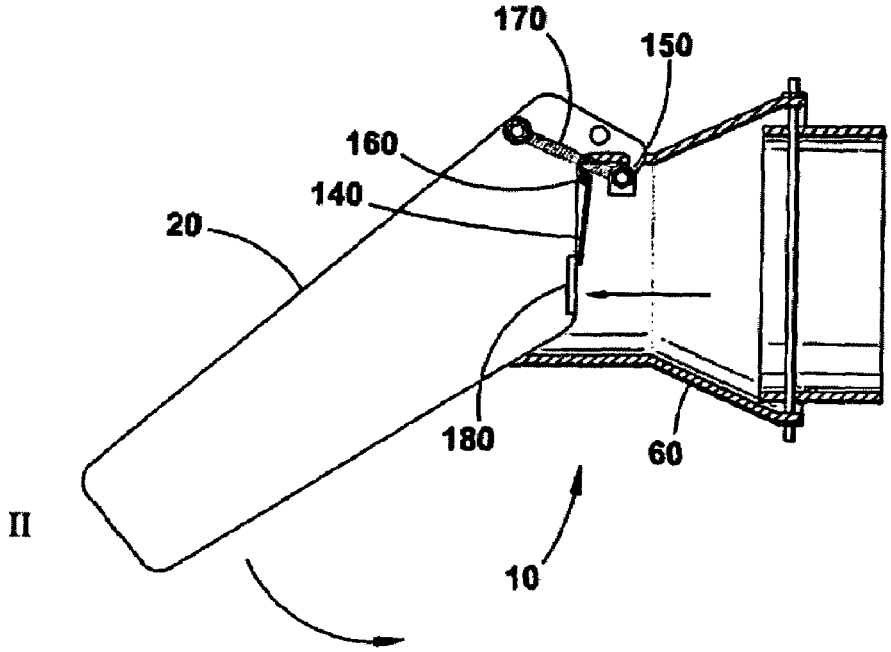
Figure 4:
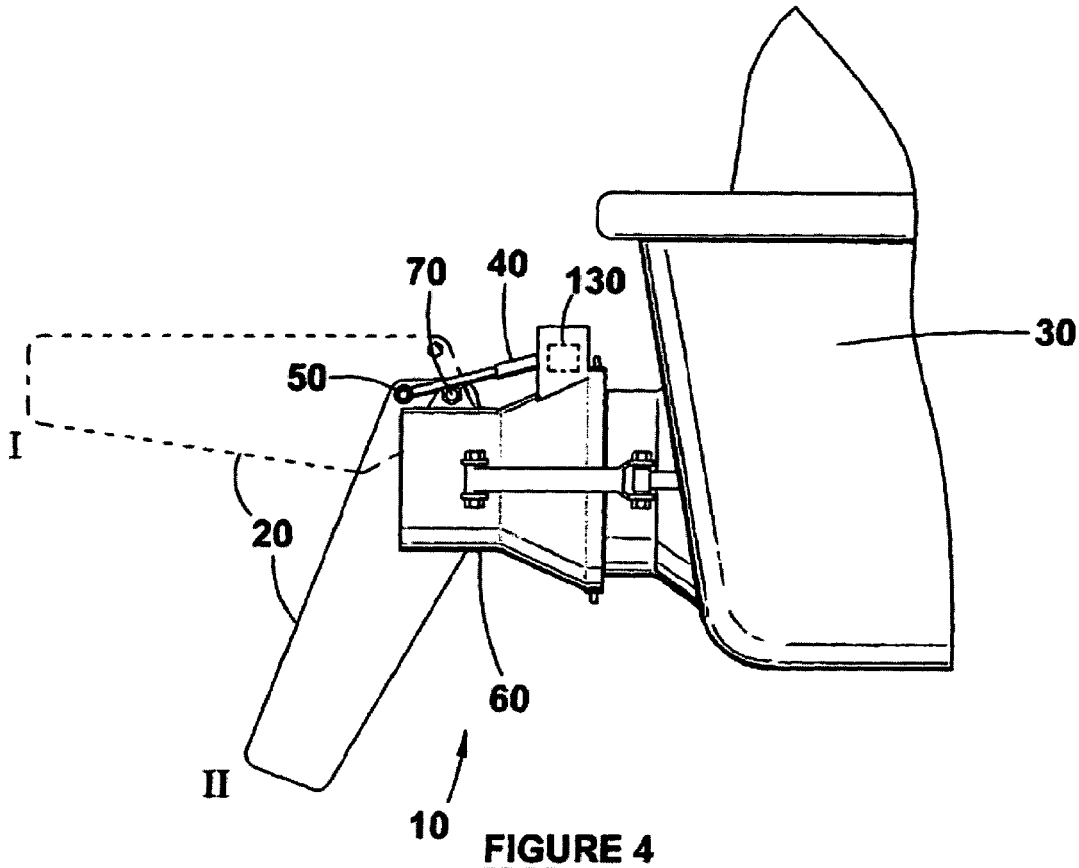
Figure 5:
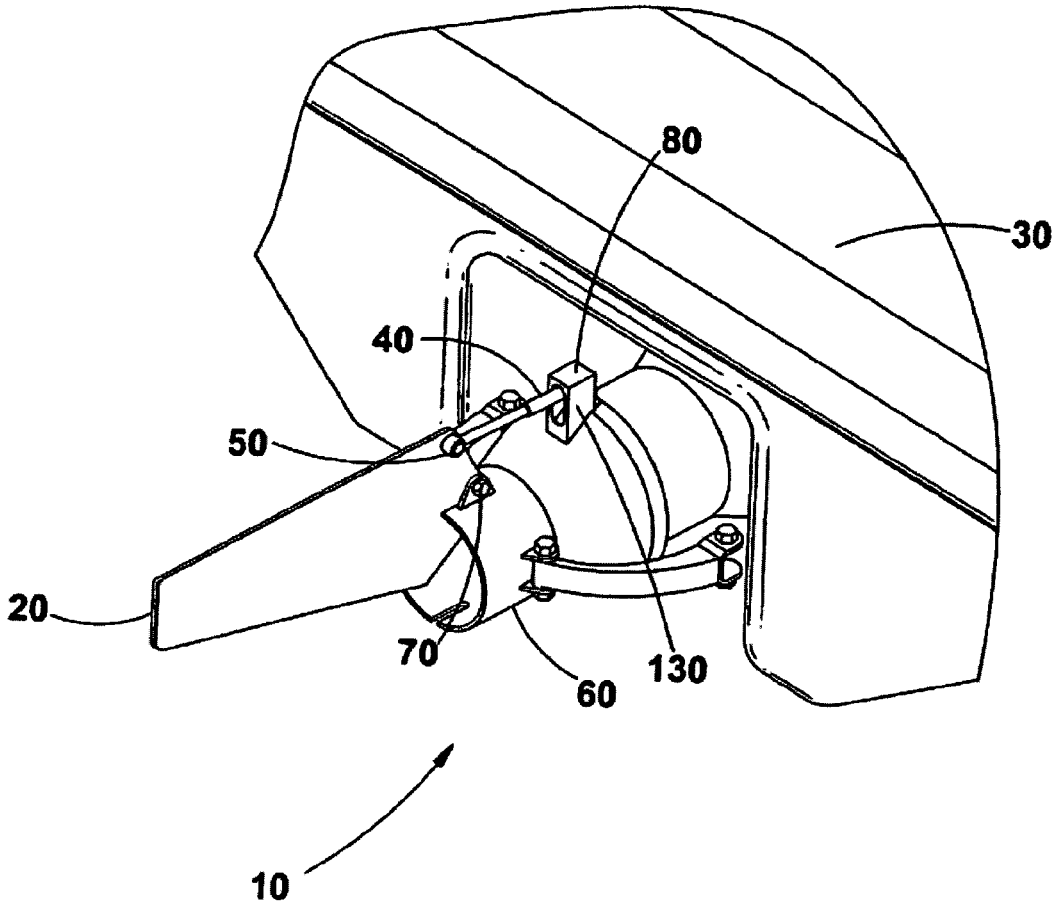
Figure 6:
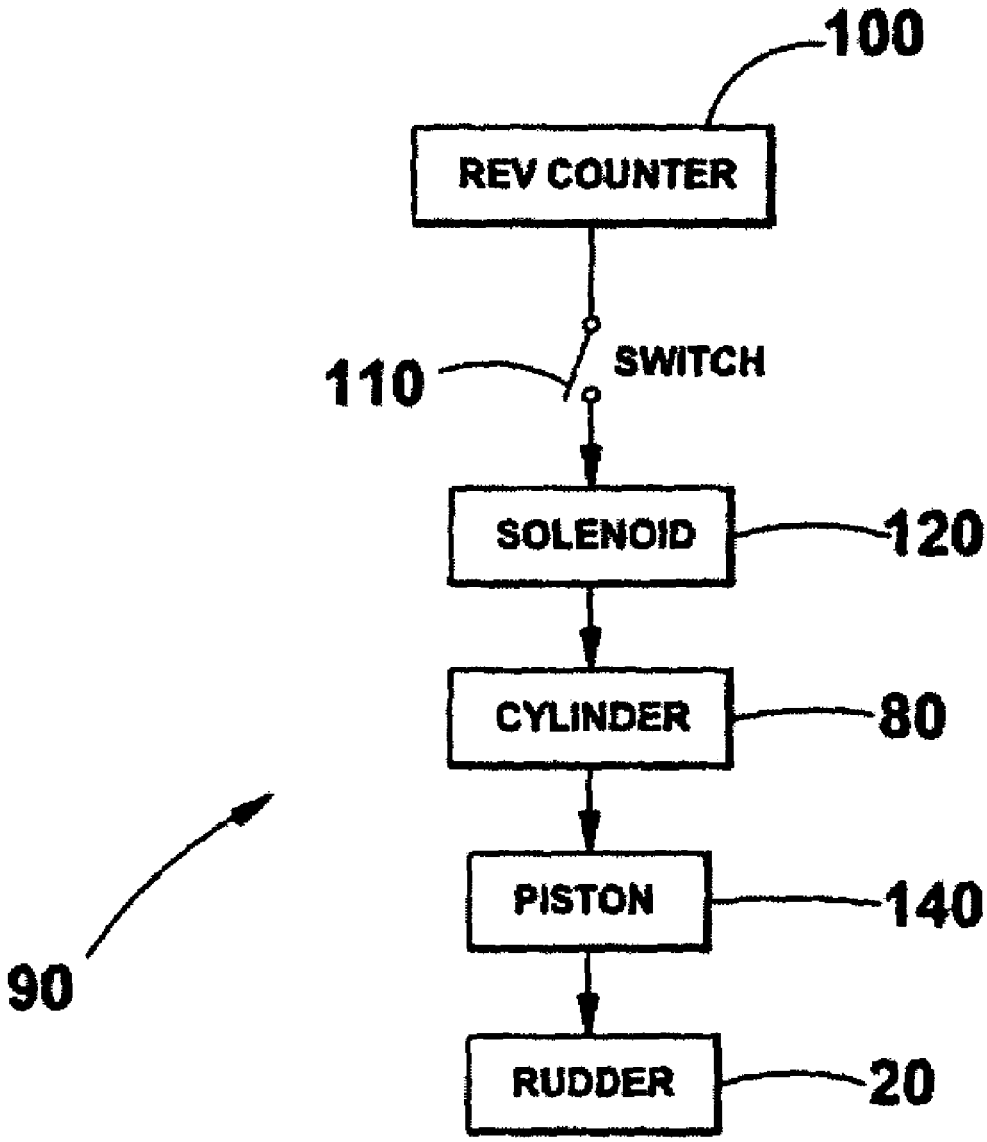

at high speeds), and position II depicts the rudder in a steering position (i.e. at low speeds);

FIG. 2 is a perspective view of the steering mechanism according to this embodiment of the invention;

FIG. 3*a* is a profile view showing the engagement of the rudder and the plate member when in the non-steering position (position I) at high speeds;

FIG. 3*b* is a profile view showing the engagement of the rudder and the plate member when in the steering position (position II) at low speeds;

FIG. 4 is a profile view showing the steering mechanism according to a second embodiment of the invention, wherein position I depicts the rudder in a non-steering position (i.e., at high speeds), and position II depicts the rudder in a steering position (i.e., at low speeds);

FIG. 5 is a perspective view of the steering mechanism according to this embodiment of the invention; and FIG. 6 is a diagrammatic representation of the actuating means in one of the alternative embodiments of the invention.

DETAILED DESCRIPTION OF DRAWINGS

Referring to the drawings, a steering mechanism in accordance with the invention is provided, referred to generally by numeral 10, incorporates a rudder 20 that is coupled to the steering column (not shown) of the watercraft 30. The steering mechanism 10 is secured to the outlet nozzle 60 of the watercraft 30 by means of a steel nut-and-bolt arrangement 70.

FIGS. 3*a* & 3*b* depict a biasing means according to a preferred embodiment of the invention, wherein the biasing means comprises a plate member 140 and a rudder 20. The rudder 20 is attached to the steering outlet nozzle 60 of the watercraft 30 at it's upper end. The rudder 20 has a hook-like catch member 150 at its upper attached end that is biased to move in a downwards position by a spring 170 which is attached at one end to the rudder 20 and at the other end to the watercraft nozzle 60 in an offset fashion. The plate member is pivotable about a pivot 160. At low speeds, the free end of the rudder 20 drops under gravity and spring tension, and its hook-like formation 150 disengages from the subjacent plate member 140, thereby causing the rudder 20 to move into the steering position as the direction of bias changes.

Conversely, at high speeds, the higher water pressure acting against the forward surface of the rudder 20 compels the rudder 20 to pivot upwardly in the direction of the water's surface, in which case the hook-like formation 150 engages with the plate member 140.

When, after the speed of the watercraft 30 falls below the predetermined level, the watercraft is caused to accelerate, the increase in water pressure will again cause the rudder 20 to pivot in the direction of the water's surface, and the hook-like formation 150 to engage with the plate member 140 as the rudder becomes biased in the non-steering position. This process of engaging and disengaging the rudder into the steering and non-steering positions respectively may be repeated ad infinitum. The rudder 20 is disposed of a further plate member 180, in a substantially ventral position (i.e., facing the outlet nozzle 60); the further plate member 180 aiding the hydrodynamics of the rudder 20 through water, and thus facilitating the engaging/disengaging process described above.

In an alternative embodiment of the invention, as depicted in FIGS. 4 to 6, the steering mechanism 10 further incorporates a biasing means comprising pneumatic pistons 40 and lugs 50. The pneumatic pistons 40 are, in turn, coupled to a pneumatic cylinder 80, which forms part of the actuating means (indicated generally by reference numeral 90 in FIG. 6). It should be noted that the actuation means 90 could alternatively be a hydraulic piston and cylinder arrangement in which pistons 40 and cylinder 80 are hydraulic, rather than pneumatic.

As shown in FIG. 6, a further component of the actuating means 90 in this embodiment of the invention is the revolution counter of the engine 100, which is coupled to an electrical solenoid 120 via a switch 110 that is built into the revolution counter 100, and which is activated on the watercraft speed falling below a predetermined level. The solenoid 120, when so activated, permits the opening of a valve 130 on a source of pressure—in this instance, being the pneumatic cylinder 80—which allows for the release of pressure from the pneumatic cylinder 80, causing the displacement of a pneumatic piston 40. This displacement of the pistons 40, in turn, results in a reversal of the direction of the bias of the rudder 20, as it is moved into the steering position.

While the embodiments described above show what is envisaged as the more practical embodiments of the invention, it is understood that the concept of actuating a rudder 20 against a bias in an automatic response to the speed of a watercraft could also be used in alternative embodiments, in particular the biasing of the rudder to a steering position, and the automatic actuation of the movement of the rudder towards a non-steering position, on the speed of the watercraft dropping below a predetermined level.

It will further be appreciated that numerous embodiments of the invention may be performed without departing from the scope of the invention as defined in the consistory statements above.

The invention claimed is:

1. A steering mechanism for jet-propelled watercraft comprising:

a rudder, the rudder being movable between a steering and a non-steering position and configured to couple with a steering column of the watercraft when in a steering position, and incorporating a plate member located in a substantially ventral position;

securing means for securing the steering mechanism to the watercraft;

biasing means for biasing the rudder towards a non-steering position; and actuating means for actuating the movement of the rudder towards the steering position automatically, upon the speed of the watercraft dropping below a predetermined level, and wherein the biasing means incorporates a spring-loaded engaging member that is configured to engage the plate member of the rudder at high speeds or high nozzle velocities, and to disengage from the plate member at low speeds or low nozzle velocities.

2. A steering mechanism as claimed in claim 1, wherein the steering mechanism is affixed to an outlet nozzle of the watercraft.

3. A steering mechanism as claimed in claim 1, wherein the securing means incorporates nut-and-bolt fixtures for affixing the steering mechanism to the body of the watercraft.

4. A steering mechanism as claimed in claim 1, wherein the biasing means incorporates a piston-and-lug arrangement that biases the rudder towards the non-steering position.

5. A steering mechanism as claimed in claim 4, wherein the lug is coupled to the actuating means.

6. A steering mechanism as claimed in claim 1, wherein the actuating means is adapted to detect the speed of the watercraft, and, on detecting that the speed of the watercraft has dropped below a predetermined level, overcomes the biasing means to reverse the direction of its bias, allowing the rudder to move towards the steering position.

7. A steering mechanism as claimed in claim 1, wherein the actuating means is adapted to detect the rate of revolutions of the watercraft engine and may incorporate speed-sensitive apparatus which, on the engine-revolutions of the watercraft dropping below a predetermined level, overcomes the biasing means to reverse the direction of its bias, allowing the rudder to move towards the steering position.

8. A steering mechanism as claimed in claim 1, wherein the actuating means is adapted to detect water pressure by a water pressure detection means, and to actuate movement of the rudder in response to the detected water pressure.

9. A steering mechanism as claimed in claim 8, wherein the water pressure detection means detects water pressure within the outlet nozzle of the watercraft.

10. A steering mechanism as claimed in claim 1, wherein the actuating means operates by means of pressurized fluid.

11. A steering mechanism as claimed in claim 10, wherein the source of pressurized fluid is a pressurized cylinder.

12. A steering mechanism as claimed in claim 11, wherein the pressurized fluid is released from the pressurized cylinder for use in the actuation means by a solenoid.

13. A steering mechanism as claimed in claim 1, wherein the actuation means is a pneumatic piston and cylinder arrangement.

14. A steering mechanism as claimed in claim 1, wherein the actuation means is a hydraulic piston and cylinder arrangement.

15. A steering mechanism for jet-propelled watercraft comprising:

a rudder, the rudder being movable between a steering and a non-steering position and configured to couple with a steering column of the watercraft when in a steering position, and incorporating a plate member located in a substantially ventral position;

securing means for securing the steering mechanism to the watercraft;

biasing means for biasing the rudder towards the steering position, and actuating means for automatically actuating the movement of the rudder towards the non-steering position, upon the speed of the watercraft dropping below a predetermined level, and wherein the biasing means incorporates a spring-loaded engaging member that is configured to engage the plate member of the rudder at high speeds or high nozzle velocities, and to disengage from the plate member at low speeds or low nozzle velocities.

* * * * *